US005176930A

United States Patent [19]

Kannankeril et al.

[11] Patent Number: 5,176,930

[45] Date of Patent: Jan. 5, 1993

[54] FOOD PACKAGE AND ABSORBENT PAD WITH EDGE WICKING

[75] Inventors: Charles P. Kannankeril, North Caldwell, N.J.; Bruce A. Cruikshank, Wilton, Conn.

[73] Assignee: Sealed Air Corporation, Saddle Brook, N.J.

[21] Appl. No.: 685,522

[22] Filed: Apr. 15, 1991

[51] Int. Cl.[5] ..... B65D 85/00

[52] U.S. Cl. ..... 426/124; 206/204; 426/129; 426/326; 426/396; 428/34.2; 428/74; 428/138

[58] Field of Search ..... 426/124, 129, 326, 396; 206/204; 428/34.2, 34.3, 74, 138

[56] References Cited

U.S. PATENT DOCUMENTS

| | | | |
|---|---|---|---|
| 4,275,811 | 6/1981 | Miller | 426/124 |
| 4,321,997 | 3/1982 | Miller | 426/124 |
| 4,410,578 | 10/1983 | Miller | 426/124 |
| 4,619,361 | 10/1986 | Thomas, Jr. | 426/124 |
| 4,720,410 | 1/1988 | Lundquist | 426/124 |
| 4,935,282 | 6/1990 | Pawlowski et al. | 426/124 |
| 4,940,621 | 7/1990 | Rhodes et al. | 426/124 |

FOREIGN PATENT DOCUMENTS

| | | | |
|---|---|---|---|
| 1037877 | 8/1966 | United Kingdom | 426/129 |
| 1168925 | 10/1969 | United Kingdom | 426/129 |

*Primary Examiner*—Steven Weinstein
*Assistant Examiner*—Jean L. Aberle
*Attorney, Agent, or Firm*—Bell, Seltzer, Park & Gibson

[57] ABSTRACT

A food package and absorbent pad therefor provides for absorption of liquids from the edges thereof and an increased rate of absorbency by the pad including upper and lower layers of normally liquid impervious material and an intermediate layer of absorbent material therebetween, at least one of the upper and lower layers are perforated to admit liquids into the pad by capillary action and a portion of the absorbent intermediate layer extends to the periphery of the pad to wick liquids into the pad, the upper and lower layers and the portion of the intermediate layer are secured together around the periphery of the pad without significantly hindering the wicking of liquids into the pad while substantially preventing reverse migration of liquids out of the pad. Additives may be incorporated in the pad to provide super absorbency, bactericidal characteristics or deodorization.

16 Claims, 1 Drawing Sheet

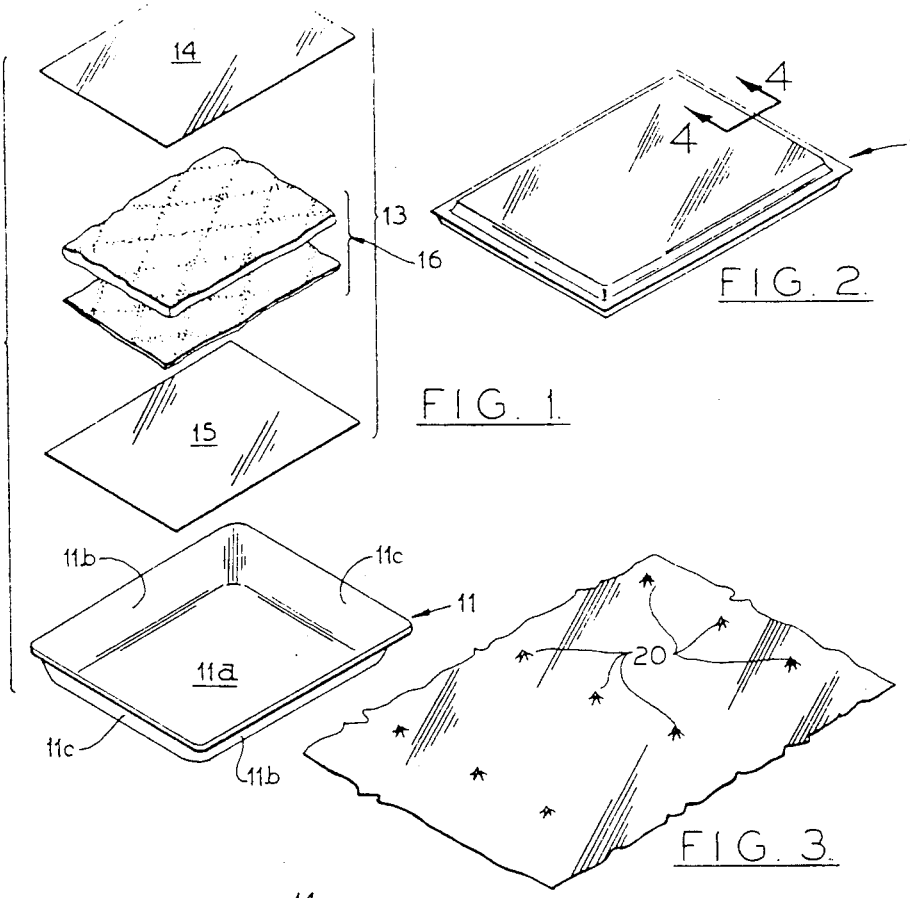
FIG. 1.
FIG. 2.
FIG. 3.
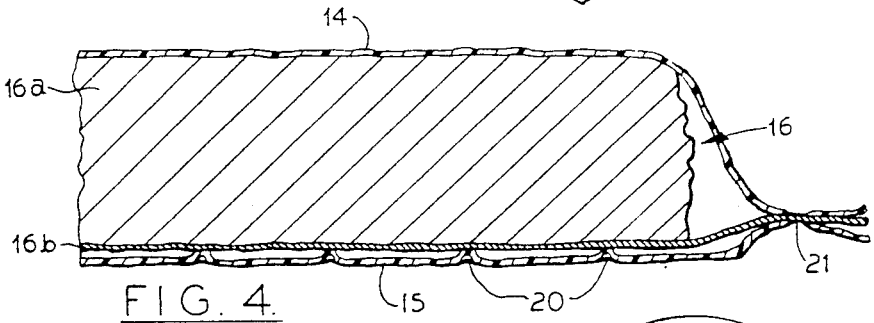
FIG. 4.
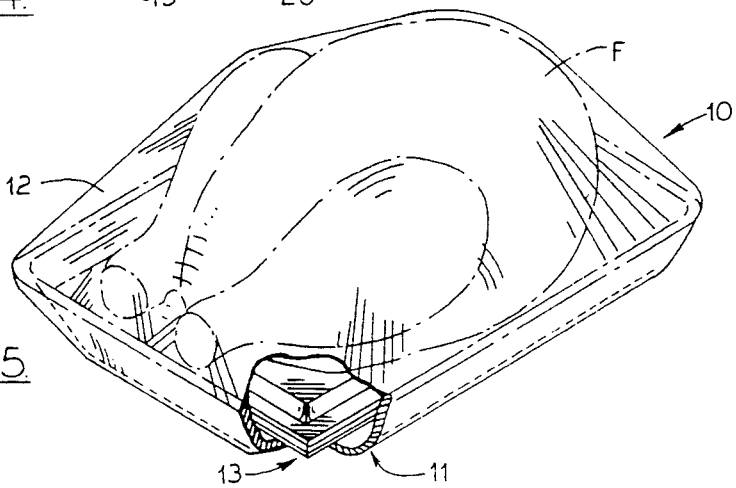
FIG. 5

FOOD PACKAGE AND ABSORBENT PAD WITH EDGE WICKING

FIELD AND BACKGROUND OF THE INVENTION

The present invention relates to a food package of the type used to contain and display various food products, and more particularly to such a food package including an absorbent pad having an increased rate of absorbency.

It is conventional practice to display meat, poultry and certain other food products in individual packages which comprise a supporting tray or other container with an absorbent pad of tissue-like paper wadding in the bottom of the tray or container to absorb any juices or liquids exuded from the food product. A transparent outer plastic wrapping is also usually employed to cover and surround the food product and tray to complete the package.

In an effort to extend the shelf-life of such food products, various and sundry absorbent pads have been proposed. U.S. Pat. Nos. 4,275,811 and 4,321,997 to Miller and owned by the assignee of the present invention disclose an absorbent pad which has been particularly successful in food product packages for absorbing juices or other exuded liquids. The absorbent pad disclosed therein comprises a mat of liquid absorbent material, an upper liquid impermeable plastic sheet overlying the absorbent mat, and a perforated lower plastic sheet underlying the absorbent mat. The upper and lower plastic sheets extend beyond the absorbent mat and are sealed together to enclose the absorbent mat therebetween. When a food product is positioned upon the upper sheet of the absorbent pad, any exuded liquids will flow around the pad and enter the pad by capillary action through the perforations in the lower sheet, and the liquids will be held out of contact with the food product to thereby minimize contamination of the food product and maintain its appearance and improve its shelf-life.

Previously proposed absorbent pads have exhibited some difficulties in absorbing liquids exuded from food products when the food packages ar disposed in an attitude other than horizontal. Food packages frequently are stored or displayed in a tilted or angled position with one side or end of the package much lower than the opposite side or end. With the food package so tilted, the liquids exuded from the food product will flow to the lowermost side or end of the package. Previously proposed food pads have exhibited difficulty in absorbing such liquids because the liquids may be either out of o only in partial contact with the perforations in the lower layer.

While providing a sufficient rate of absorbency for food products, certain food products exude liquids in such amounts and at such rates that previous absorbent pads cannot absorb the exuded liquids rapidly enough to prevent the exuded liquids from returning into contact with the food product. Certain pads have been proposed in which the absorbent mat was exposed along the edges of the pad by having the upper and lower plastic layers either not sealed together or sealed together only along a portion of the periphery of the pad. Problems have been experienced with such prior pads in that the absorbent mat can wick more liquids into the mat than the absorbent material thereof can retain. Accordingly, the wicked-in liquid often leaks out of the pad and may return into contact with the food product.

SUMMARY OF THE INVENTION

It is therefore an object of the present invention to provide a food package, and an absorbent pad therefore, which overcome the deficiencies and disadvantages of prior food packages and absorbent pads.

It is a more specific object of the present invention to provide an absorbent pad for a food package which will absorb all liquids exuded by the food product even if the food package is stored in an attitude other than horizontal.

It is a still more specific object of the present invention to provide an absorbent pad for a food package in which an increased rate of absorbency is provided without the possibility of significant amounts of liquids wicked into the pad leaking therefrom and returning into contact with the food product.

The foregoing objects of the present invention are accomplished by providing a food package having an absorbent pad therein which provides for wicking of liquids into the pad, as well as for absorption of liquids through the lower sheet by capillary action. In accordance with this invention, the absorbent pad comprises upper and lower sheets of flexible thermoplastic film and an absorbent mat confined between the two sheets of plastic film. At least the lower sheet of plastic film is preferably perforated so as to become liquid pervious and to admit liquid into the interior of the pad through capillary action.

At least a portion of the absorbent mat extends outwardly between the upper and lower layers of plastic film so that this portion of the absorbent mat comes into contact with liquid exuded from the food product and wicks that liquid into the interior of the pad. The upper and lower layers of plastic film and the portion of the absorbent mat are secured together around the periphery of the pad in such a way that the wicking of liquids into the interior of the pad for absorption by the absorbent mat is not substantially hindered while preventing any substantial or significant leakage of liquids out of the pad whereby such liquids are prevented from returning into contact with the food product.

BRIEF DESCRIPTION OF THE DRAWINGS

FIG. 1 is an exploded perspective view of an absorbent pad and food tray embodying the features of the present invention;

FIG. 2 is a perspective view of the pad shown in FIG. 1;

FIG. 3 is a fragmentary, enlarged perspective view of the lower layer of the pad shown in FIGS. 1 and 2;

FIG. 4 is an enlarged, fragmentary sectional view taken substantially along line 4—4 in FIG. 2; and FIG. 5 is a perspective view of a food package embodying the features of the present invention.

DESCRIPTION OF THE PREFERRED EMBODIMENT

Referring more specifically to the drawings, there is shown in FIG. 5 one form of a food package 10 embodying the features of the present invention. As illustrated, food package 10 includes a tray 11 and an overwrap 12 of transparent flexible material, such as polyethylene film. Tray 11 is formed of any suitable material, such as expanded polystyrene, molded pulp or any other material compatible with the food products desired to be contained and displayed in the food package 10.

Tray 11 includes a bottom wall 11*a*, side walls 11*b* and end walls 11*c* integrally formed to provide a receptacle or container for receiving and containing therein a food product F, illustrated in the form of a chicken carcass in FIG. 5. While preferred, tray 11 is not the only type or form of receptacle or container for the food product F. Such containers may be in any form currently employed in packaging food products for display, storage, etc. For example, it is well known that food products may also be packaged in plastic film bags, as well as various and sundry other containers, including paperboard boxes.

The present invention also contemplates that the food package 10 include an absorbent pad 13 (FIG. 2) resting on the bottom wall 11*a* of the container and adapted to receive the food product F thereon. The absorbent pad 13 will support the food product thereon and is adapted to absorb liquids in the form of juices, water or the like exuded from the food product during display, storage, handling and the like. Absorbent pad 13 includes an upper layer 14 preferably of liquid impervious plastic film material, such as plastic film, e.g. polyethylene, or release coated paper, e.g. cellophane silicone coated paper or quilon-coated paper, and a lower layer 15 which is preferably liquid pervious. Pad 13 also includes an intermediate layer 16 comprising a mat of absorbent material which is disposed between the upper and lower layers 14 and 15.

At least one of the upper and lower layers 14 and 15 preferably have a plurality of perforations 20 formed therein to impart liquid permeability to the normally liquid impervious material from which the upper and lower layers are formed. Preferably, only lower layer 15 has perforations 20 therein, while upper layer 14 remains liquid impervious. Accordingly, any liquids exuded from the food product which rests on upper layer 14 will flow outwardly along upper layer 14 to the edges of pad 13 and downwardly beneath the pad into contact with lower layer 15. The perforations 20 in lower layer 15 cause the liquid to pass upwardly therethrough by capillary action into the interior of pad 13 where such exudants are absorbed by the intermediate layer 16.

Intermediate layer 16 comprises a mat 16*a* of absorbent fibers, such as wood fluff, which are relatively inexpensive and highly absorbent. It should be understood that, while preferred, the wood fluff could be replaced by several layers of absorbent tissue paper. To isolate the very short wood fluff fibers in the mat 16*a* from the perforations 20, a layer of tissue paper 16*b* is preferably placed between the mat 16*a* and the lower layer 15 to act as a mechanical barrier between the perforations 20 and the short wood fluff fibers. The tissue layer 16*b* may be of any suitable paper which has sufficient integrity to maintain its structure when wet by liquids exuded from the food product. One such material is commonly referred to as facial grade tissue or wet strength tissue.

Various additives may be included in or on intermediate layer 16 to increase its liquid absorbency, to provide bactericidal properties or to provide deodorizer capability. To provide increased absorbency, a super absorbent polymer additive, such as a synthesized starch, e.g. the starch-acrylonitrile graft co-polymer as described in U.S. Pat. No. 3,661,815 or carboxy methyl cellulose, may be incorporated in or provided on the surface of mat 16*a*. Additionally, a bactericidal agent, such as potassium sorbate, may be added to the intermediate layer 16 to retard bacteria growth. Finally, a food grade deodorizing agent, such as lemon scent, may be added to intermediate layer 16 to mask undesirable odors.

The upper and lower layers 14 and 15 extend beyond the periphery of the mat 16*a* and are secured together around the periphery of the mat 16*a* as indicated in FIG. 4 at 21. In accordance with the present invention, the rate of absorbency of pad 13 is enhanced and increased and pad 13 is provided with the capability of absorbing liquids in food packages stored or displayed in a attitude other than horizontal, by having at least a portion of the intermediate layer 16 extend outwardly between upper and lower layers 14 and 15 to the outer periphery of the pad 13 so as to contact any liquids exuded from the food product to wick such liquids into the interior of pad 13 for absorption therewithin. In the illustrated embodiment, the portion of intermediate layer 16 that extends outwardly between the upper and lower layers 14 and 15 to the periphery of the pad is the tissue layer 16*b* (FIG. 4). The tissue layer 16*b* and the upper and lower layers 14 and 15 are secured together at 21, as by an adhesive, such as a hot melt adhesive.

The adhesive securement 21 does not significantly interfere with the wicking action of tissue layer 16*b* so that tissue layer 16*b* can still wick substantial amounts of liquid into the interior of the pad 13. However, it has been determined that the adhesive securement 21 will substantially prevent any liquids wicked into the interior of pad 13 from any significant reverse migration or leaking back out of the pad. Accordingly, all liquids passing into the interior of the pad either through perforations 20 or by the wicking action of tissue layer 16*b* will be substantially confined therein and prevented from returning into contact with the food product.

In certain instances, the weight of the food product resting on absorbent pad 13 may limit the capability of the absorbent pad 13 to absorb a sufficient quantity or amount of liquid so that all of the liquids exuded by the food product may not be absorbed. The present invention contemplates that such absorbency limitations may be obviated by the inclusion in absorbent pad 13 of load bearing additives or spacers to resist compression of intermediate layer 16 of absorbent pad 13 by the food product. Any inert load bearing elements, such as ground or comminuted polyethylene foam or strips of air bubble-type packaging material, may be incorporated in intermediate layer 16 in a manner not shown.

In the figures and specification, there has been disclosed a preferred embodiment of the invention. While specific terms are employed, they are used in a generic and descriptive sense only, and not for purposes of limiting the scope of the invention as set forth in the following claims.

That which is claimed is:

1. A food package for displaying and storing a food product adapted to exude liquids therefrom characterized by an increased rate of absorbency and by the ability of absorb liquids exuded from the food product irrespective of the usual positions in which the food package is stored or displayed, said package comprising a container for confining and displaying a food product, including a bottom wall for supporting the food product thereon, and an absorbent pad disposed within said container and overlying and resting upon said bottom wall thereof, said pad comprising upper and lower layers of normally liquid impervious material and an intermediate layer of absorbent material, said intermediate layer having two superposed portions, one of which extends to the periphery of the absorbent pad between said upper and lower layers so as to contact liquid exuded from a food product and wick that liquid into the interior of said pad for absorption by said intermediate layer, the other portion of said intermediate layer being confined wholly within said upper and lower layers, said upper and lower layers and said one portion of said intermediate layer being secured together around the periphery of said absorbent pad to prevent any substantial amount of liquids which enter the interior of the absorbent pad to form a seal spaced outwardly from said other portion of said intermediate layer and from reverse migration therefrom without significantly interfering with the wicking action of said one portion of said intermediate layer.

2. A food package according to claim 1 wherein said container comprises a tray having a bottom wall and side and end walls integral therewith and an overwrap of film material covering said tray.

3. A food package according to claim 1 wherein said intermediate layer comprises a plurality of layers of absorbent material, one layer of which extends to the outer periphery of the pad between said upper and lower layers.

4. A food package according to claim 3 wherein said intermediate layer comprises a mat of wood fluff fibers and a layer of tissue disposed between said mat and said perforated layer, and wherein said tissue layer extends to the periphery of the pad.

5. A food package according to claim 4 wherein said upper, lower and tissue layers are adhesively secured together around the outer periphery of the pad.

6. A food package according to claim 1 wherein at least one of said upper and lower layers have a plurality of perforations therein to make the same liquid permeable so that liquids exuded by the food product will also penetrate into said pad through said perforations to be absorbed by said intermediate layer.

7. A food package according to claim 1 wherein said intermediate layer includes a super absorbent polymer.

8. A food package according to claim 1 wherein said absorbent pad includes a bactericidal agent between said upper and lower layers to retard bacteria growth within said absorbent pad.

9. A food package according to claim 1 wherein said absorbent pad includes a food grade deodorizing agent between said upper and lower layers to mask undesirable odors in said food package.

10. An absorbent pad for use in a food package characterized by the capability of absorbing liquids from the edges thereof and by an increased rate of absorbency, said pad comprising upper and lower layers of normally liquid impervious material, an intermediate layer of absorbent material disposed between said upper and lower layers for absorbing liquids exuded from a food product, said intermediate layer comprising first and second superposed portions, said first portion extending outwardly to the periphery of said pad between said upper and lower layers to wick liquids exuded from a food product into said pad, said second portion being confined wholly within the interior of said pad between said upper and lower layers, and means securing said upper and lower layers and said first portion of said intermediate layer together around the outer periphery thereof to form a seal spaced outwardly from said second portion of said intermediate layer without significantly hindering or interfering with the wicking action of said first portion of said intermediate layer while preventing substantially reverse migration of liquids from the interior of said pad.

11. An absorbent pad according to claim 10 wherein at least one of said upper and lower layers have a plurality of perforations therein to make the same liquid permeable so that liquids exuded by the food product will also penetrate into said pad through said perforations to be absorbed by said intermediate layer.

12. An absorbent pad according to claim 11 wherein said intermediate layer comprises a mat of wood fluff fibers and at least one layer of tissue paper disposed between said mat and said at least one perforated layer, and wherein said at least a portion of said intermediate layer extending to the periphery of said pad is said tissue layer.

13. An absorbent pad according to claim 12 wherein said means securing the upper, lower and tissue layers together is an adhesive and extends around the periphery of said pad.

14. An absorbent pad according to claim 10 further comprising a super absorbent polymer between said upper and lower layers to provide substantially increased absorbency in said absorbent pad.

15. An absorbent pad according to claim 10 further comprising a bactericidal agent between said upper and lower layers to retard bacteria growth in said absorbent pad.

16. An absorbent pad according to claim 10 further comprising a food grade deodorizing agent between said upper and lower layers to mask undesirable odors within said absorbent pad.

* * * * *

UNITED STATES PATENT AND TRADEMARK OFFICE

CERTIFICATE OF CORRECTION

PATENT NO. : 5,176,930

DATED : January 5, 1993

INVENTOR(S) : Charles P. Kannankeril et al.

It is certified that error appears in the above-identified patent and that said Letters Patent is hereby corrected as shown below:

Column 1, line 44, "ar" should be -- are --.

Column 1, line 53, "o" should be -- or --.

Column 4, line 61, "of" should be -- to --.

Column 5, line 14, after "pad" insert -- to form a seal spaced outwardly from said other portion of said intermediate layer and --.

Column 5, lines 16-18, after "pad" delete -- to form a seal spaced outwardly from said other portion of said intermediate layer and --.

Signed and Sealed this

Nineteenth Day of October, 1993

Bruce Lehman

*Attest:*

BRUCE LEHMAN

*Attesting Officer*

*Commissioner of Patents and Trademarks*